US008251073B2

(12) United States Patent
Sparacia et al.

(10) Patent No.: US 8,251,073 B2
(45) Date of Patent: Aug. 28, 2012

(54) METHOD AND KIT FOR THE MULTIPLE TREATMENT OF A HEAD OF HAIR

(76) Inventors: Karen Sparacia, Rye (GB); William Sparacia, Rye (GB)

( * ) Notice: Subject to any disclaimer, the term of this patent is extended or adjusted under 35 U.S.C. 154(b) by 0 days.

(21) Appl. No.: 13/109,504

(22) Filed: May 17, 2011

(65) Prior Publication Data

US 2012/0090632 A1 Apr. 19, 2012

(30) Foreign Application Priority Data

Oct. 14, 2010 (GB) ..... 1017348.2
Feb. 16, 2011 (EP) ..... 11154716

(51) Int. Cl.
*A45D 24/00* (2006.01)
*A45D 7/00* (2006.01)
*A45D 19/18* (2006.01)
*A42B 1/00* (2006.01)

(52) U.S. Cl. ..... 132/200; 132/270; 2/171.02

(58) Field of Classification Search ..... 132/201, 132/200, 208, 270, 207, 212, 213, 221, 222, 132/240, 241, 250, 273, 274, 319, 333, 275; 2/171.02, 171.1, 171.2, 171.4, 181, 181.4, 2/209.14, 209.3, 209.7, DIG. 11; 401/9, 401/10, 207
See application file for complete search history.

(56) References Cited

U.S. PATENT DOCUMENTS 2,781,048 A * 2/1957 Le Donne ..... 132/214
3,030,632 A * 4/1962 Shelton ..... 2/209.3
3,101,724 A * 8/1963 Nizetich ..... 132/270
3,800,811 A * 4/1974 Esposto ..... 132/270
4,259,972 A * 4/1981 Spaccapaniccia ..... 132/212
4,665,933 A 5/1987 Zinger et al.
5,042,514 A * 8/1991 Bastien ..... 132/270
5,056,538 A * 10/1991 Matula ..... 132/208
5,299,367 A * 4/1994 Johnson et al. ..... 34/95
5,845,655 A * 12/1998 Iwata ..... 132/212
5,845,657 A * 12/1998 Carberry et al. ..... 132/273
5,901,711 A * 5/1999 Jeremy ..... 132/226
6,035,862 A * 3/2000 Di Luca ..... 132/270
6,148,829 A * 11/2000 De Benedictis ..... 132/207
6,276,368 B1 * 8/2001 Giamalva ..... 132/201
2004/0089316 A1 * 5/2004 Hamilton et al. ..... 132/208
2006/0174907 A1 * 8/2006 Morris et al. ..... 132/274
2009/0139538 A1 * 6/2009 Cheung ..... 132/270

FOREIGN PATENT DOCUMENTS

CN 2835211 11/2006
NL 1020368 10/2003

OTHER PUBLICATIONS

International Search Report issued in related European Patent Application No. EP11154716.

* cited by examiner

*Primary Examiner* — Vanitha Elgart

(57) ABSTRACT

The method includes the sequential steps of gathering a first section (11) of hair from the head and passing the first section (11) of hair through a first hollow open-ended shield (21), gathering a second section (13) of hair from the head, laying the second section (13) against the outer surface (31) of the first shield (21), and treating the second section (13) of hair with a first coloring agent. A second hollow open-ended shield (23) is positioned around the first shield (21) and the second section (13) of hair, a third section of hair is gathered from the head, laid against the outer surface (33) of the second shield (23), and treated with a second coloring agent.

21 Claims, 9 Drawing Sheets

METHOD AND KIT FOR THE MULTIPLE TREATMENT OF A HEAD OF HAIR

FIELD OF THE INVENTION

Figure 1:
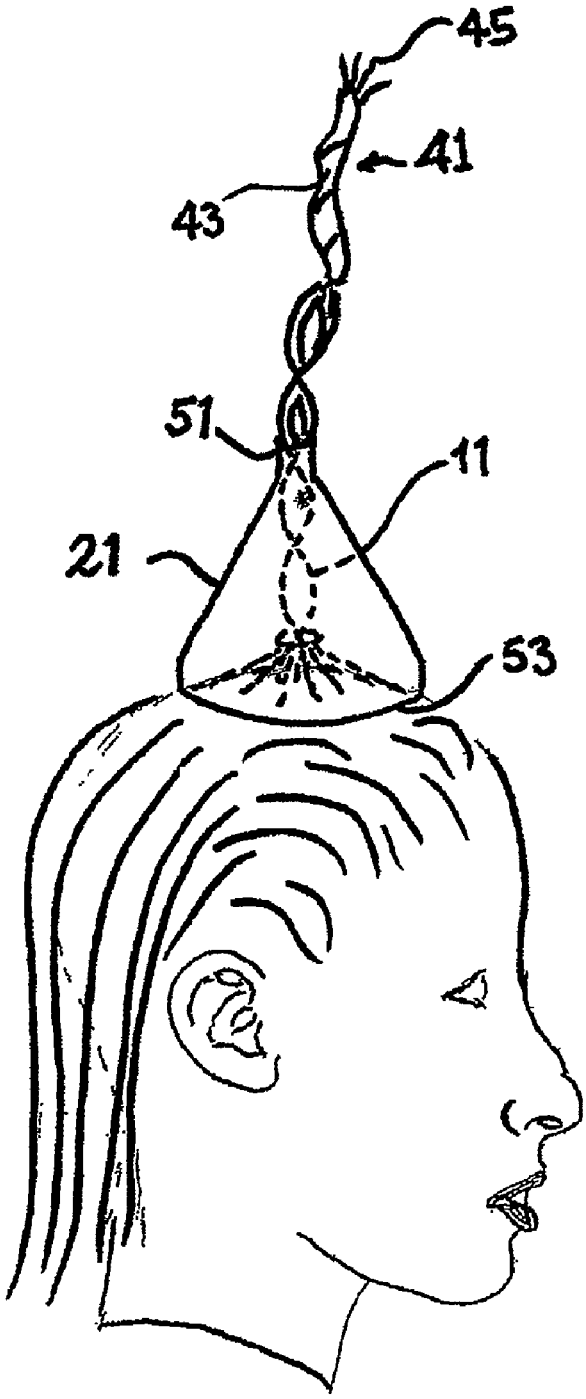

The present invention relates to a method for the multiple treatment of a head of hair, such as colouring of sections of the head of hair in different colours, and to a kit of parts for carrying out such a method.

BACKGROUND TO THE INVENTION

Treatment of an individual's head of hair, for example to colour the hair, is well known. A particularly popular style of treatment is to provide sections of the head of hair with a different colour to the bulk of the hair, e.g. to provide so-called □highlights□. It is also becoming popular to provide different sections of the hair with different colours, such as up to seven different colours. The method for achieving this effect used to date is to separate one section of hair, to treat that section of hair with a colouring agent and after allowing time for that agent to take effect, rinsing and drying the hair. This process is repeated with another section of the hair and another colouring agent, and so on until the final desired effect has been achieved. not only does this method take considerable time, but there is a risk of one colour □bleeding□ into another colour if the different sections of the hair to be treated cannot be kept strictly apart.

We are aware of U.S. Pat. No. 4,665,933 (Zinger et al.) which describes a system of dyeing human hair which is performed by layering the hair in separating members referred to as tiers and selectively dyeing each layer. The separating members are annular ellipsoids whose major and minor axes are in the same ratio and are fabricated in sets of ascending size. Each separating member has disposed along its inner circumference, evenly spaced comb tooth-like projections.

We are also aware of Netherlands patent NL 1020368 (Veenstra) which describes a similar hair treatment method in which a set of N separating members referred to as elements, is used, where N is a whole number, each element being designed to be placed on the head and provided with a surface over which the hair can be spread. The treatment method comprises the following steps: (a) placing the first element on the head; (b) spreading a layer of hair over the first element; (c) treating the layer of hair above the first element; and (d) repeating steps (a)-(c) for one or more additional elements, each of which is located at a distance from the previous element.

In both Zinger et al. and Veenstra the separating members of different sizes are placed on the head in an array in descending circumference, that is the separating member with the largest circumference is used first and then progressively separating members of smaller and still smaller circumference. As a consequence, these proposals suffer from several disadvantages.

Firstly, because a lower section of hair is treated before treating a higher hair section, there is a risk that treatment liquids used for a higher hair section may drip onto an already treated lower hair section, thereby leading to mixing and bleeding of colours. This gravity effect acts against creating effects with clearly demarcated colour regions.

Because the separating members extend away from the head, it is difficult to wash the hair without removing those separating members, but in so doing the various sections of hair will come in contact with each other risking mixing and bleeding of dye from one hair section to another.

Furthermore, that section of hair below the largest circumference separating member cannot be separately treated using these prior proposals.

Because the treated hair sections in these proposals are exposed, the chemical reactions involved in the bleaching and/or dyeing process are slow and it may be necessary to complete these reactions under a heat lamp. This would involve removing the separating members before these reactions are complete, again risking mixing and bleeding of colour from one hair section to another.

It is an object of the present invention to provide a method and a kit of parts which enable the aforesaid disadvantages to be overcome.

SUMMARY OF THE INVENTION

According to a first aspect of the invention, there is provided a method for the multiple treatment of a head of hair, including the sequential steps of:

a) gathering a first section of hair from the head and passing the first section of hair through a first hollow open-ended shield;

b) gathering a second section of hair from the head, laying the second section against the outer surface of the first shield, and treating the second section of hair with a first colouring agent;

c) positioning a second hollow open-ended shield around the first shield and the second section of hair, gathering a third section of hair from the head, laying the third section against the outer surface of the second shield, and treating the third section of hair with a second colouring agent.

By retaining each section of hair to be treated within the confines of its own shield, bleeding of colour from one section to another is largely prevented. Also, it is no longer necessary to rinse and dry the hair after each colour has been applied, thereby enabling a considerable saving on time.

The present invention requires that each next shield is placed on the head around the previous shield, i.e. the smallest shield is used first and then progressively larger and larger shields are used.

Because a higher section of hair is treated before treating a lower hair section, and after treatment the higher hair section is protected behind the next shield, there is no risk that treatment liquids used for a lower hair section may come into contact with the already treated higher hair section, thereby avoiding mixing and bleeding of colours. This enables effects to be created with more clearly demarcated colour regions than was possible using the methods described in U.S. Pat. No. 4,665,933 and NL 1020368.

It is also an advantage of the present invention that, because the shields are placed on the hair in the order from the smallest to the largest, each section of hair after it has been treated is covered and protected by the next shield. This covering of the treated hair sections helps to retain moisture, and body heat from the scalp, both of which serve to speed up the chemical reactions involved in bleaching or dyeing. The spacing between each shield acts a thermal chimney, drawing up heat from the scalp, heating the full length of the selected treated hair section, and reducing evaporation, thereby guaranteeing even colour from root to tip by keeping the treating agent moist. In other words, heat rising from the scalp and being directed up a thermal chimney retains moisture and creates an even heat distribution, allowing a longer activation window due to the colouring agent being kept moist. Also the regulated heat along the entire length of the treated hair leads to a faster and more even colour activation from root to tip. Thus, it is no longer essential to use a heat lamp to complete these reactions after all hair sections have been completed and the shields removed. Mixing and bleeding of colour from one hair section to another is thereby avoided.

It is an advantage of the present invention that the treated hair sections of the hair can be washed in order, without the shields impeding this process, in contrast to the methods described in U.S. Pat. No. 4,665,933 and NL 1020368. Mixing and bleeding of colour from one hair section to another is thereby avoided.

While the invention as defined above applies only two colours to sections of the head of hair, the method will more usually comprise the further steps of positioning a further hollow open-ended shield around the previously positioned shields and the previously gathered and treated section of hair, gathering a further section of hair from the head, laying the further section against the outer surface of the further shield, and treating the further section of hair with a colouring agent. In a preferred embodiment, this further step is repeated one or more times.

The second and the or each further colouring agent will usually be different from the immediately precedingly used colouring agent. Overall, the number of different colours may correspond to the number of treated sections of hair, although it is possible that some sections which are not adjacent to each other may be treated with the same colouring agent.

The second and each subsequent section of hair from the head preferably surrounds the immediately precedingly gathered section, so as to achieve an end result in which the sections of hair being coloured are a series of circles, one within the next, in a target-like appearance.

After the first section of hair is passed through the first open-ended shield, the free end portions of the hair filaments making up the first section may be wrapped in a flexible protective sheet material and the free ends are wedged into the distal opening of the shield to thereby secure the first shield in position. In place of, or in addition to, the protective sheet material, some other form of easily removable protection device could be used, such as may be clipped on to the free end portion of the first section of hair which projects through the first shield. Such a protection device should be capable of being removed after all sections of hair to be treated have been treated, without removing the shields, so that the free end portion of the first section of hair can also be treated if desired. In an alternative embodiment the first section of hair is twisted together, then folded over, an elongate hair clip is located at the fold and the hair clip carrying this first hair section is inserted through the distal end opening in the shield and adjusted in position to lie across the mouth of that opening, thereby to hold the first hair section in place, substantially all within the confines of the first shield.

Because each section of hair which is to be treated is lifted away from the scalp and is held vertically while the treatment reactions take place, it is easier to avoid applying treatment liquid to the scalp (which is generally not advised) but rather rely upon the capillary effect to spread the treatment liquid along the length of hair. This avoidance of contact between the treatment liquid and the scalp is not possible with the methods described in U.S. Pat. No. 4,665,933 and NL 1020368.

Each colouring agent is preferably independently selected from hair bleaching agents and hair dyes.

According to a second aspect of the invention, there is provided a kit of parts for carrying out the above defined method, comprising a plurality of hollow open-ended shields and instructions for carrying out the method.

Each hollow open-ended shield is preferably in the form of a truncated pyramid or cone or of an inverted funnel, having a relatively large opening at its proximal end to be positioned against the head, and a relatively small opening at its distal end away from the head. The first shield may have a proximal opening diameter as small as 10 cm, and subsequent shields may have proximal opening diameter up to as large as 50 cm. The first shield may have a distal opening diameter as small as 2 cm, and subsequent shields may have proximal opening diameter up to as large as 10 cm. The kit may usefully contain from three to seven shields of different sizes.

The method of the invention enables more than one pattern of concentric coloured hair sections to be obtained, for example by applying the method of the invention with one sequence of colours to one side of the head and then applying the method of the invention with another sequence of colours (which may be the same as or different to the first sequence) to the other side of the head. The effect produced could not be achieved with the methods described in U.S. Pat. No. 4,665,933 and NL 1020368.

Each shield may be formed of a transparent material especially a light-weight transparent material, such as a plastics material.

The shields are ideally of such shape and configuration as to be capable of nesting within each other. The material of which the shields are formed should be sufficiently rigid to ensure that, when nested together, a continuous, e.g. annular spacing between the shield can be reliably provided, thereby to provide the thermal chimney referred to above. To achieve this, the conical angles of the truncated cones and/or inverted funnels are preferably approximately the same.

The shields preferably have a generally circular cross-section.

The set of instructions included in the kit may be in the form of printed matter, optionally including a web-site address, or electronic information, such as a CD, DVD or other memory device, or some combination of such forms.

The kit may optionally include other items, such as a plurality of colouring agents, combs, clips, elastic bands, tin foil or other items useful in the carrying out of the method.

Figure 5:
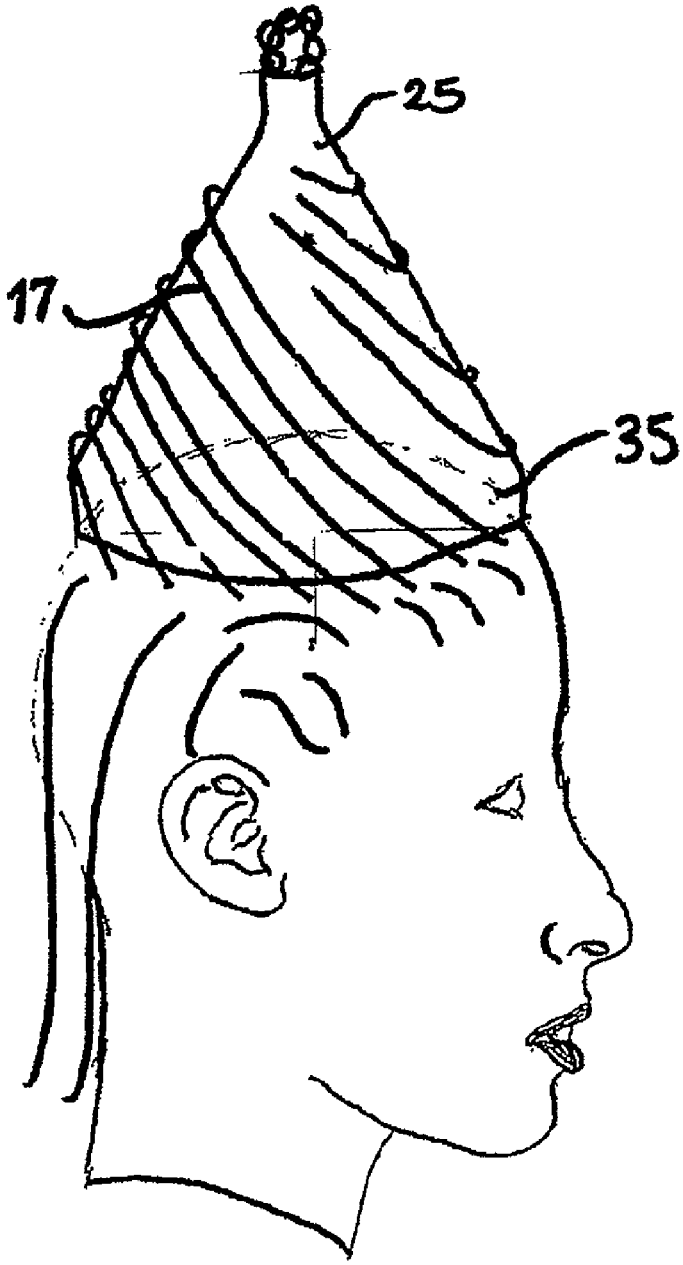
Figure 6:
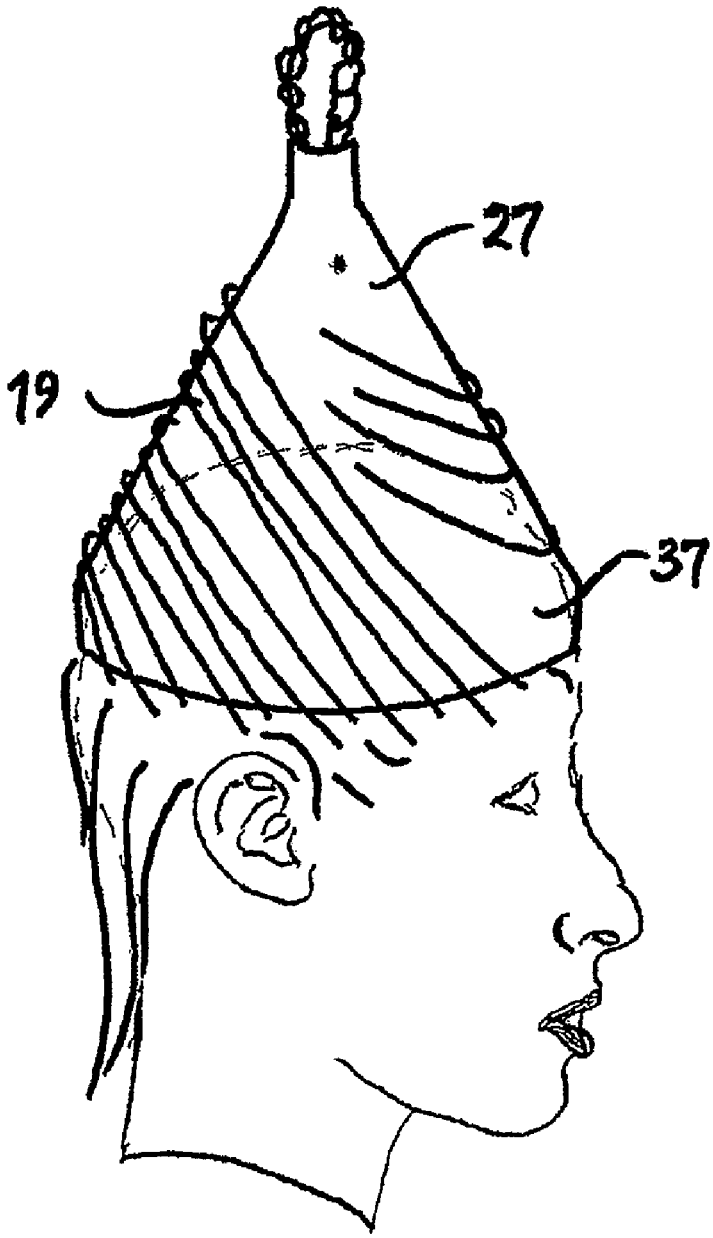
Figure 7:
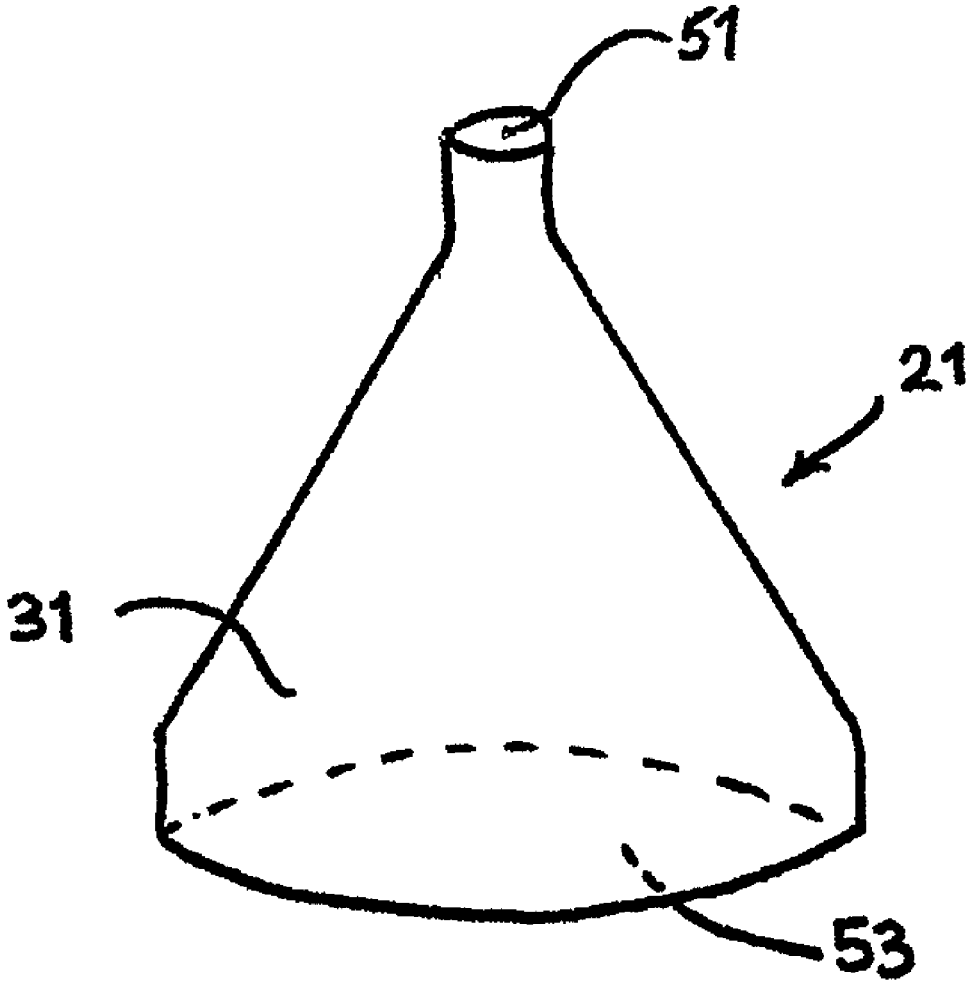
Figure 8:
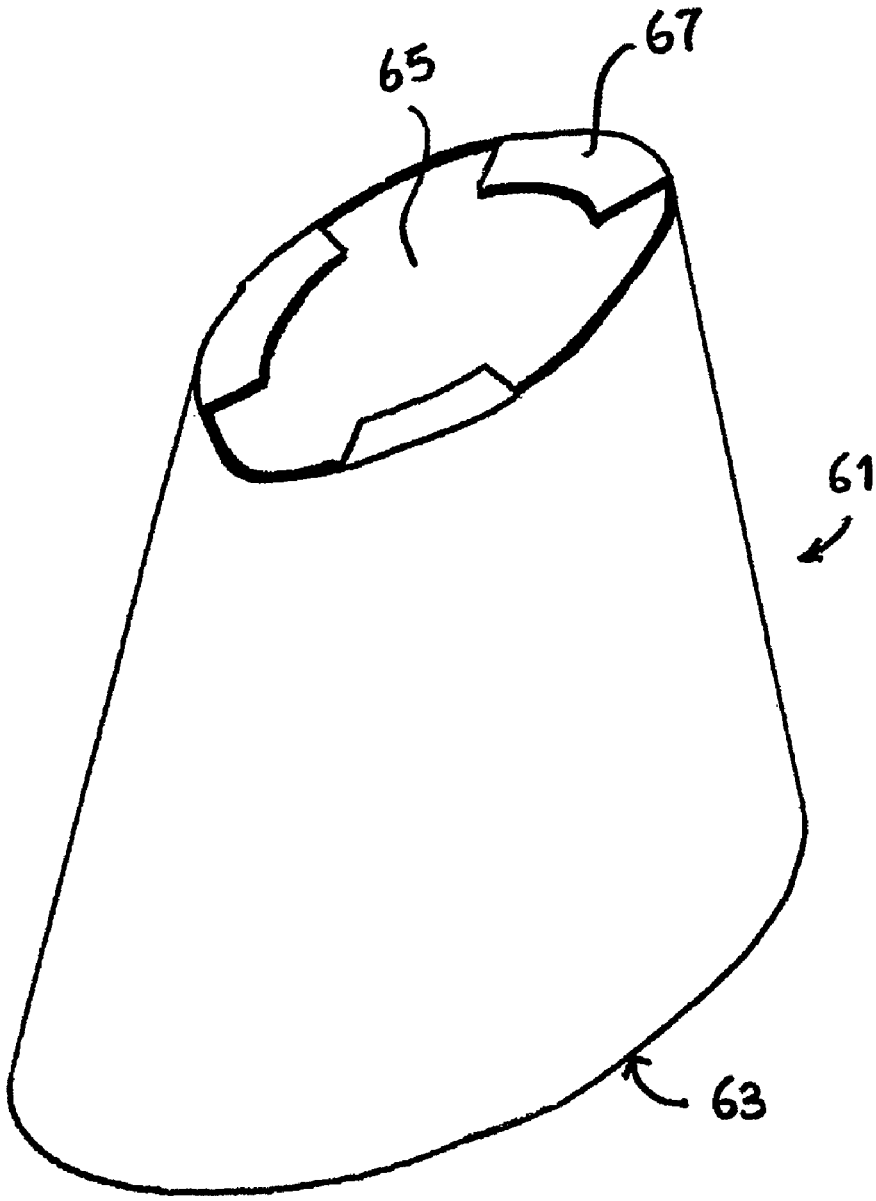
Figure 9:
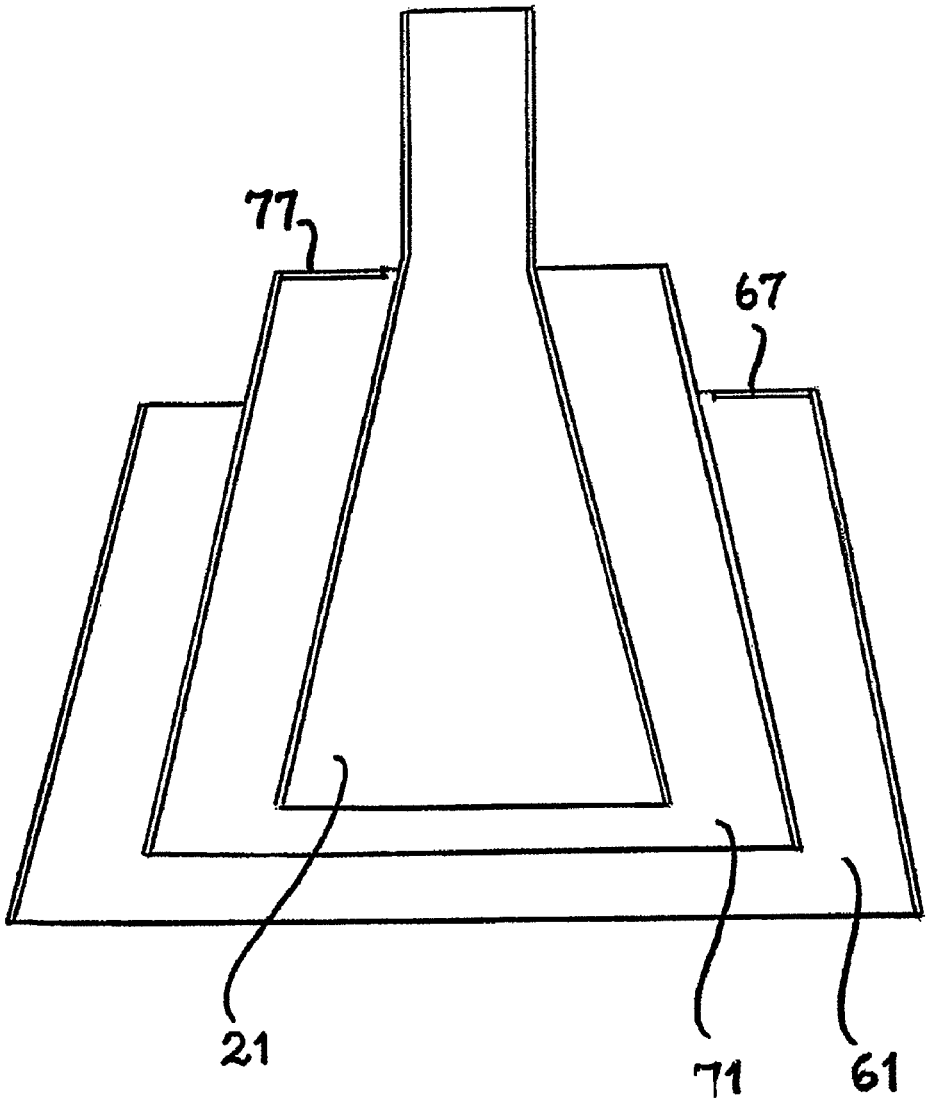

The invention will now be further illustrated, by way of example, with reference to the accompanying drawings in which:

FIGS. 1 to 6 show sequential steps in a method according to the present invention, FIG. 7 shows one of the shields for use in the method, FIG. 8 shows an alternative embodiment of a shield for use in the method of the invention, and FIG. 9 shows in cross-section the nesting of shields for use in the method of the invention.

Referring to the drawings, a method for the multiple treatment of a head of hair is illustrated.

The method makes use of a kit of parts which includes a number of (four as illustrated) hollow open-ended shields 21, 23, 25, 27. Each shield 21, 23, 25, 27 is in the form of an inverted funnel of generally circular cross-section (see FIG. 7), having a relatively large opening 53 at its proximal end and a relatively small opening 51 at its distal end. Each shield 21, 23, 25, 27 is formed of a suitable transparent plastics material, such as, but not limited to, polyethylene. The shields 21, 23, 25, 27 are of different sizes and have such shapes and configurations as to be capable of nesting within each other. More specifically, the four shields have proximal opening diameters of 10, 12, 14 and 16 cm while the distal opening diameters are respectively 2.0, 2.4, 2.8 and 3.2 cm respectively.

The kit also includes a number of liquid hair colouring agents, such as a hair bleaching agent and a number of hair dyes of different colour shades.

Figure 2:
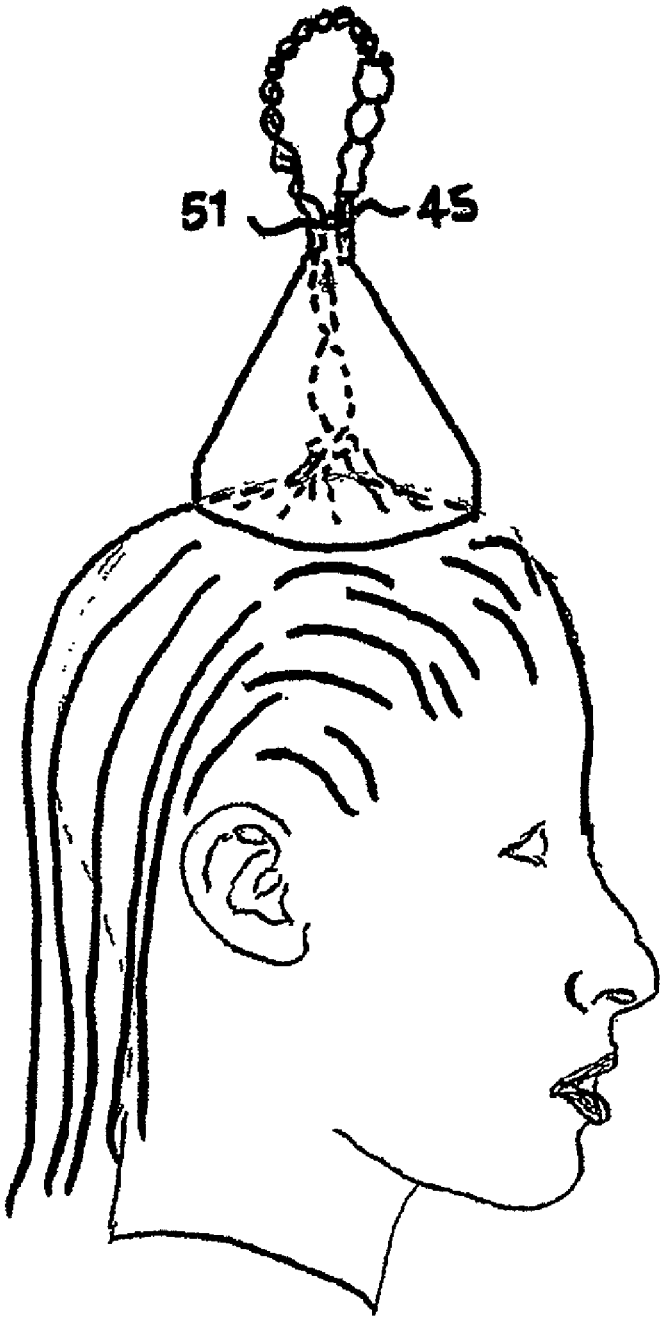

The initial step of the method is gathering a first section 11 of hair from the crown of the head, for example using a spiral hook having a widest diameter approximating that of the widest diameter of the first shield 21, and holding this first section together with an elastic band close to the head. The free end portions 41 of the hair filaments making up the first section 11 are twisted together and wrapped in metal foil 43 and passed through the first shield 21 positioned with its proximal opening 53 against the head and its distal opening 51 away from the head, as shown in FIG. 1. After the first section 11 of hair is passed through the first open-ended shield 21, the free ends 45 are wedged into the distal opening 51 of the shield 21 to thereby secure the first shield 21 in position, as shown in FIG. 2.

Figure 3:
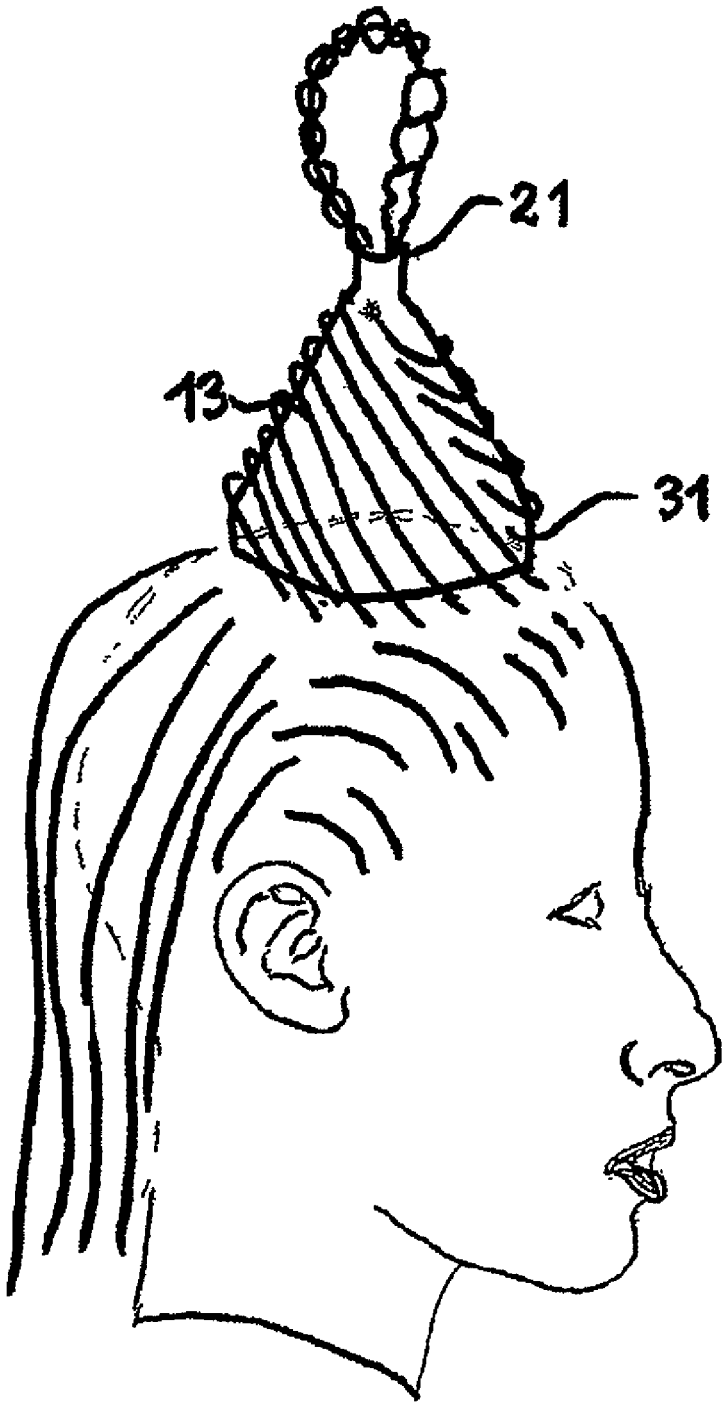

A second section 13 of hair, which surrounds the first gathered section is then gathered from the head, treated with a first colouring agent from the kit, for example with a brush or spatula, and laid against the outer surface 31 of the first shield 21, as shown in FIG. 3. The colouring agent helps to hold the hair against the outer surface of the shield.

Figure 4:
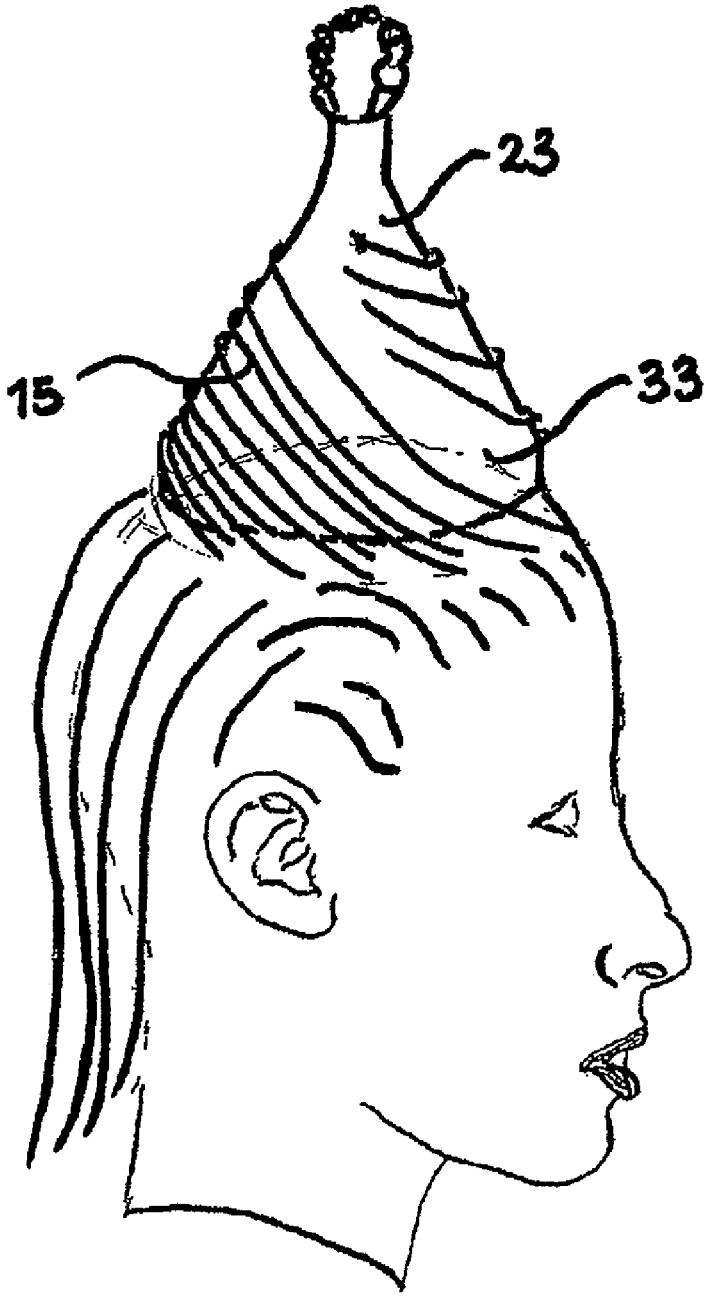

The second shield 23 is then positioned in nesting relationship around the first shield 21 and the second section 13 of hair. A third section 15 of hair, which surrounds the second gathered section in the form of a ring, is gathered from the head, treated with a second colouring agent from the kit, different from the first colouring agent, and laid against the outer surface 33 of the second shield 23, as shown in FIG. 4.

The third shield 25 is then positioned in nesting relationship around the previously positioned shield 23 and the previously gathered and treated section 15 of hair. A fourth section 17 of hair, which surrounds the third gathered section in the form of a ring, is gathered from the head, treated with a third colouring agent from the kit, different from the second colouring agent, and laid against the outer surface 35 of the third shield 25, as shown in FIG. 5.

The fourth shield 27 is then positioned in nesting relationship around the previously positioned shield 25 and the previously gathered and treated section 17 of hair. A fifth section 19 of hair, which surrounds the gathered section in the form of a ring, is gathered from the head, treated with a fourth colouring agent, different from the third colouring agent, and laid against the outer surface 37 of the fourth shield 27, as shown in FIG. 6.

After each treatment step, the progress of the colouring reaction can be monitored through the transparent shields.

These steps are repeated a number of times, using further shields and further colouring agents, until the desired effect is produced. Once the second, third, fourth and any subsequent sections of hair 13, 15 and 17 have been treated as described above, the first section of hair 11 may also be treated by removing the foil 43, teasing out the hair from its twisted condition and treating it with a colouring agent, different from that used to treat the second section 13. The shields can then be removed and the treated hair is ready for rinsing and drying.

The result is a head of hair having concentric regions of different colours, the overall effect being different according to the manner in which the hair may be subsequently styled.

In a particular example of the method, a head of hair was treated in accordance with the invention with seven different colouring agents, rinsed and dried in about 20 minutes. A comparable treatment, carried out by prior art methods, takes several hours.

As shown in FIG. 8, a shield 61 may be in the form of a truncated cone of generally circular cross-section having a relatively large opening 63 at its proximal end and a relatively small opening 65 at its distal end. The shield is formed of a transparent plastics material such as polyethylene. At the distal opening 65 three symmetrically spaced inwardly projecting tabs 67 are formed, each subtending an angle of about 60° about the axis of the shield.

FIG. 9 shows the nesting of an inverted funnel shield 21, of the type shown in FIG. 7, and two truncated conical shields 61 and 71, both of the type shown in FIG. 8. The projecting tabs 67 of the outer shield 61 ensure a continuous annular spacing between shields 61 and 71 in use, while the projecting tabs 77 of the second outer shield 71 ensure a continuous annular spacing between shields 71 and 21 in use. The spacings between the shields not only enables the chimney effect, described above, to be achieved, but also enable access to a treated hair section to examine the progress of colouring reactions.

The invention claimed is:

1. A method for the multiple treatment of a head of hair, characterised by including the sequential steps of:

a) gathering a first section of hair from the head and passing the first section of hair through a first hollow open-ended shield;

b) gathering a second section of hair from the head, laying the second section against the outer surface of the first shield, and treating the second section of hair with a first colouring agent;

c) positioning a second hollow open-ended shield around the first shield and the second section of hair, gathering a third section of hair from the head, laying the third section against the outer surface of the second shield, and treating the third section of hair with a second colouring agent, wherein said shields are nested together and said second shield includes means to ensure that, when said shields are nested together, a continuous spacing between the shields is provided, thereby to provide a thermal chimney drawing up heat from the scalp to heat the full length of the treated hair sections, and to reduce evaporation.

2. The method of claim 1, further comprising the steps of:

d) positioning a further hollow open-ended shield around the previously positioned shields and the previously gathered and treated section of hair, gathering a further section of hair from the head, laying the further section against the outer surface of the further shield, and treating the further section of hair with a colouring agent.

3. The method of claim 2, wherein step d) is repeated one or more times.

4. The method of claim 2, wherein the second and the further colouring agent is different from the immediately precedingly used colouring agent.

5. The method of claim 1, wherein the second and each subsequent section of hair from the head surrounds the immediately precedingly gathered section.

6. A method for the multiple treatment of a head of hair, characterised by including the sequential steps of:

a) gathering a first section of hair from the head and passing the first section of hair through a first hollow open-ended shield;

b) gathering a second section of hair from the head, laying the second section against the outer surface of the first shield, and treating the second section of hair with a first colouring agent;

c) positioning a second hollow open-ended shield around the first shield and the second section of hair, gathering a third section of hair from the head, laying the third section against the outer surface of the second shield, and treating the third section of hair with a second colouring agent, wherein after the first section of hair is passed through the first open-ended shield, the free end portions of the hair filaments making up the first section are wrapped in a flexible protective sheet material and the free ends are wedged into the distal opening of the shield to thereby secure the first shield in position.

7. The method of claim 1, wherein each colouring agent is independently selected from hair bleaching agents and hair dyes.

8. The method of claim 1, wherein each hollow open-ended shield is in the form of a truncated pyramid or cone or an inverted funnel, having a relatively large opening at its proximal end to be positioned against the head, and a relatively small opening at its distal end away from the head.

9. The method of claim 1, wherein each shield is formed of a plastics material.

10. The method of claim 1, wherein each shield has a generally circular cross-section.

11. A kit of parts for carrying out the method of claim 1, comprising a plurality of hollow open-ended shields and a set of instructions for carrying out the method.

12. The kit of parts of claim 11, wherein each hollow open-ended shield is in the form of a truncated pyramid or cone or an inverted funnel, having a relatively large opening at its proximal end to be positioned against the head, and a relatively small opening at its distal end away from the head.

13. The kit of parts of claim 11, wherein each shield is formed of a plastics material.

14. The kit of parts of claim 11, wherein each shield has a generally circular cross-section.

15. The kit of parts of claim 11, wherein said set of instructions are in a form selected from printed matter and electronic information and combinations thereof.

16. The method of claim 1, wherein said continuous spacing is a continuous annular spacing.

17. The method of claim 8, wherein said means to ensure said continuous spacing between the shields comprises inwardly projecting tabs formed at the distal opening of said second shield.

18. The method of claim 17, wherein said tabs are symmetrically located about said distal opening.

19. The kit of parts of claim 11, wherein said continuous spacing is a continuous annular spacing.

20. The kit of parts of claim 12, wherein said means to ensure said continuous spacing between the shields comprises inwardly projecting tabs formed at the distal opening of said second shield.

21. The kit of parts of claim 20, wherein said tabs are symmetrically located about said distal opening.

* * * * *